United States Patent [19]

Stuckmann et al.

[11] 4,265,565

[45] May 5, 1981

[54] TUNNEL DRIVE SHIELD

[75] Inventors: Dieter Stuckmann, Selm; Hans Jütte, Dortmund-Brechten, both of Fed. Rep. of Germany

[73] Assignee: Gewerkschaft Eisenhutte Westfalia, Lunen, Fed. Rep. of Germany

[21] Appl. No.: 941,337

[22] Filed: Sep. 11, 1978

[30] Foreign Application Priority Data

Sep. 24, 1977 [DE] Fed. Rep. of Germany ..... 2743046

[51] Int. Cl.[3] ..... E01G 3/02

[52] U.S. Cl. ..... 405/145; 405/141

[58] Field of Search ..... 405/142, 145, 138–141, 405/143, 144, 150, 151; 299/31

[56] References Cited

U.S. PATENT DOCUMENTS

| | | | |
|---|---|---|---|
| 2,197,374 | 4/1940 | Bull | 405/142 |
| 3,061,289 | 10/1962 | Robbins | 299/31 |
| 3,419,311 | 12/1968 | Scaravilli et al. | 299/31 |
| 3,800,549 | 4/1974 | Lobbe | 405/142 |
| 3,864,925 | 2/1975 | Foik | 405/145 |
| 3,866,426 | 2/1975 | Lobbe | 405/142 |
| 3,903,707 | 9/1975 | Foik | 405/142 |
| 3,926,005 | 12/1975 | Foik | 405/145 X |
| 3,979,921 | 9/1976 | Winberg et al. | 299/31 X |
| 4,045,088 | 8/1977 | Bechem | 299/31 |
| 4,048,806 | 9/1977 | Stuckmann et al. | 405/145 |
| 4,073,153 | 2/1978 | Stuckmann et al. | 405/142 |
| 4,120,165 | 10/1978 | Stuckmann et al. . | |

*Primary Examiner*—Dennis L. Taylor
*Attorney, Agent, or Firm*—Neil F. Markva

[57] ABSTRACT

A tunnel drive shield comprises a cylindrical shell supported by two axially-spaced frames. The two frames are movable, relative to one another, in the direction of tunnel advance. In order to guide the two frames accurately, guide means interconnect the two frames, the guide means permitting movement only in the direction of tunnel advance. The guide means may be constituted by a plurality of telescopic guide devices. A knife shield may constitute the drive shield.

21 Claims, 3 Drawing Figures

TUNNEL DRIVE SHIELD

BACKGROUND TO THE INVENTION

This invention relates to a drive shield for use in driving tunnels. Throughout this specification, the term "tunneL" or "tunnels" should be taken to include mine galleries, adits, trenches or other elongate excavations.

A known type of tunnel drive shield consists (see DT-AS No. 2,021,734) of a plurality of elongate planks (knives) which are arranged side-by-side and parallel to the axis of the tunnel. The planks define a generally semi-cylindrical shield and are supported by two axially-spaced frames. The planks can be advanced, either individually or in groups, by means of hydraulic rams which abut one of the frames. The frames are connected to control elements disposed along the tunnel, and are movable relative to one another in the direction of tunnel advance.

Each frame can be extended vertically so that it can be braced directly against the tunnel floor and indirectly (by way of the planks) against the tunnel walls and ceiling. During advance, the rear support frame is anchored and the front, unbraced frame pulled forward by the control elements. Then, the front frame is anchored and the rear frame is released and pulled forward by the control elements. Thus, one support frame is always under load and constitutes an abutment for the other frame. This type of drive shield suffers from a considerable defect, namely that, during advance, one of the frames (in particular the front frame) may be displaced either vertically or transversely, this displacement arising from play between the frames and the planks. This problem is exacerbated by rock and earth jamming against the advancing parts and influencing the direction of advance. Moreover, particularly in soft earth, the front frame may sag somewhat during its advance movement. Basically, therefore, this type of drive shield cannot be advanced accurately in the required direction.

The main object of the invention is to provide a tunnel drive shield that can cut through earth and rock, particularly in zones of differing compositions, along a path that coincides as closely as possible with that intended.

SUMMARY OF THE INVENTION

According to one aspect of the invention, there is provided a drive shield for use in tunneling, the drive shield comprising a generally cylindrical shell supported by two frames spaced apart along the axis of the shell, the two frames being displaceable relative to one another in the direction of said axis. The two frames are interconnected by guide means which permit relative movement therebetween only in the direction of said axis.

According to another aspect of the invention, there is provided a drive shield comprising a generally cylindrical shell supported by two axially-spaced frames which are displaceable relative to one another in the direction of tunnel advance, wherein the two frames are interconnected by guide means which permit relative movement between the two frames only in the required direction of tunnel advance.

In use, one of the frames is anchored while the other frame is advanced. The first frame is then anchored while the second is advanced in a follow-up sequence. During the advance of either frame, the guide means ensures that there is no deviation from the desired direction of tunnel advance.

Advantageously, a plurality of equispaced telescopic guide devices constitutes the guide means. This resuls in a space saving, simple and positive guide which at the same time prevents the frames from rotating relative to one another. Preferably, each guide device is constituted by a pair of telescoped tubes of polygonal cross-section, one tube of each pair being fixed to one of the frames, the other tube of each pair being fixed to the other frame. Conveniently, the tubes may be of rectangular cross-section.

Preferably, a double-acting hydraulic ram is provided within each telescopic guide device, the rams acting between the two frames to constitute means for advancing each frame relative to the other. In this way, the advance rams for the frames are protected against the ingress of earth.

The invention also provides a knife shield for use in driving tunnels, the knife shield comprising a plurality of elongate members supported by two axially-spaced frames. The elongate members are mounted in a parallel side-by-side relationship so as to define a generally cylindrical shell. The two frames are displaceable relative to one another in the direction of tunnel advance and are interconnected by guide means which permit relative movement between the two frames only in the required direction of tunnel advance.

The invention further provides a method of advancing a tunnel drive shield constituted by a generally cylindrical shell supported by two axially spaced frames, the method comprising the steps of advancing a first of the frames while maintaining the second frame stationary, and then advancing said second frame while maintaining said first frame stationary, wherein each frame is positively guided and constrained to move only in the direction of tunnel advance during its advance movement relative to the other frame, by guide means interconnecting the two frames.

BRIEF DESCRIPTION OF THE DRAWINGS

A knife shield for use in tunneling and constructed in accordance with the invention will now be described, by way of example, with reference to the accompanying drawings, in which.

DESCRIPTION OF THE PREFERRED EMBODIMENT

Figure 1:
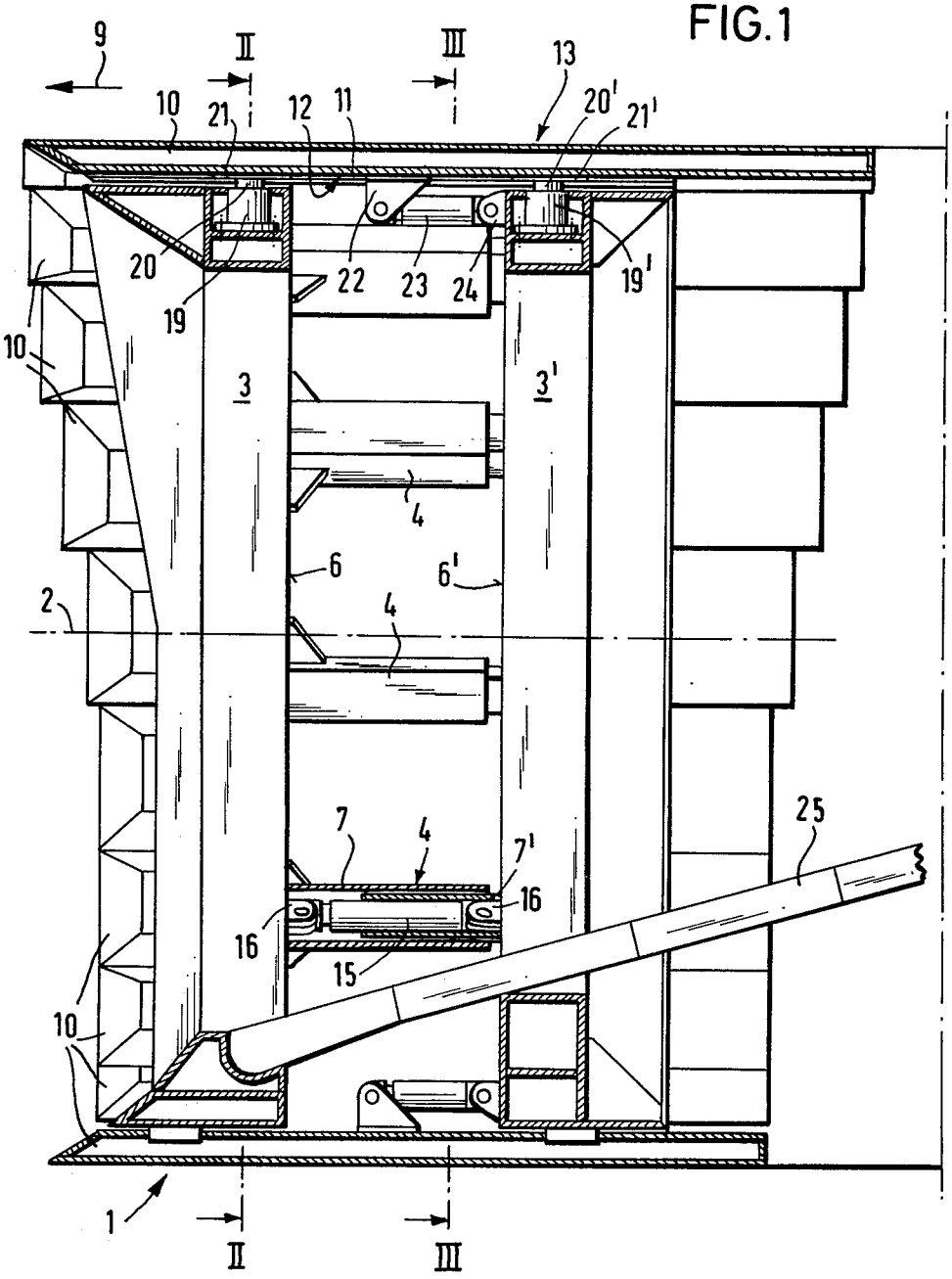
FIG. 1 is a vertical, longitudinal cross-section through the knife shield.
Figure 2:
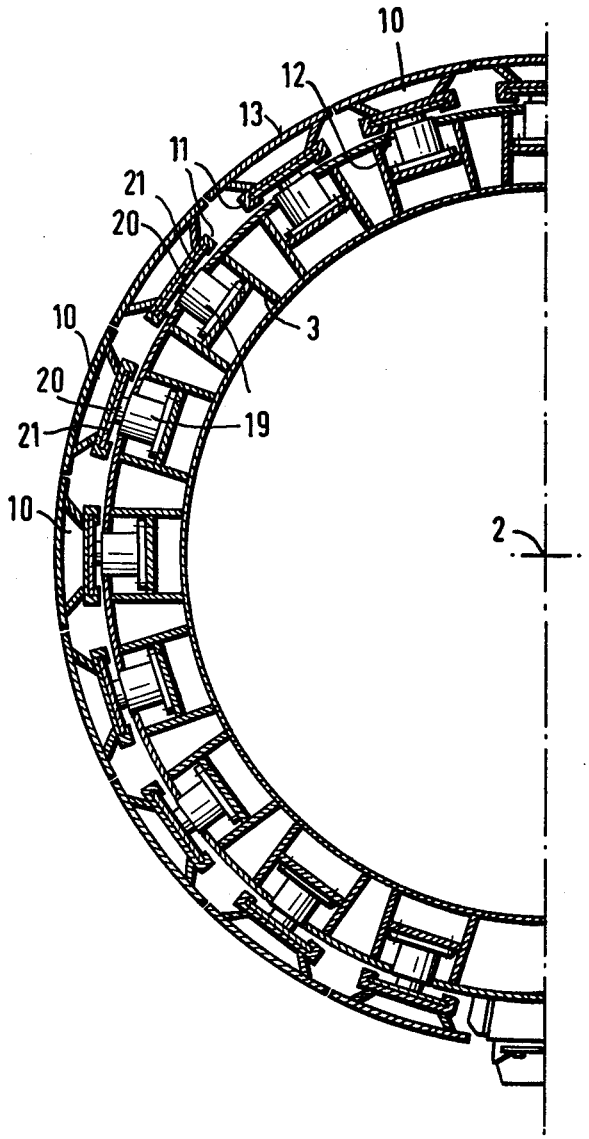
FIG. 2 is a cross-section of the left-hand side of the knife shield taken on the line II—II of FIG. 1.
Figure 3:
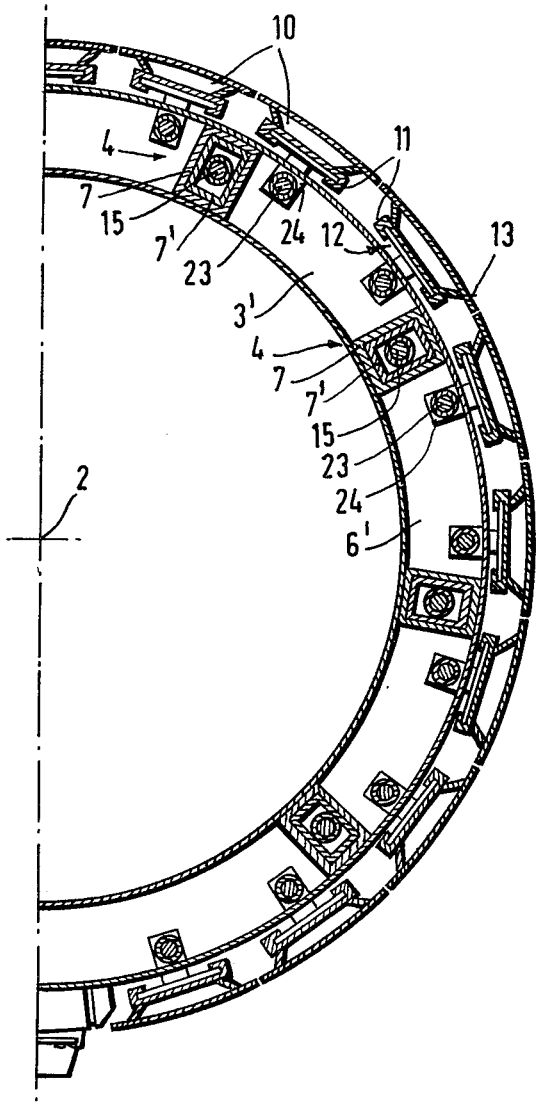
FIG. 3 is a cross-section of the right-hand side of the knife shield taken on the line III—III of FIG. 1.

Referring to the drawings, FIG. 1 shows a knife shield 1, which is to be advanced along its central longitudinal axis 2 in the direction of the arrow 9. The knife shield is constituted by a plurality of elongate planks (or knives) 10 which are arranged in a parallel, side-by-side configuration on a framework constituted by front and rear frames 3 and 3' respectively. The planks 10 define a cylindrical shield 13 and are slidably supported on the frames 3 and 3' by means of guides 11 provided on their inner surfaces 12. The front frame 3 and the rear frame 3' are relatively displaceable to one another in the direction of the axis 2. The two frames 3 and 3' are guided on one another by means of a plurality of telescopic guides 4 which are equispaced around the annular end faces 6 and 6′ of the two frames. These telescopic guides 4 are each constituted by a pair of rectangular-section tubes 7 and 7′, the tubes 7 being fixed to the annular end face 6, and the tubes 7′ to the end face 6′. Each tube 7′ is slightly smaller than its corresponding tube 7 so that it can slide easily therewithin while providing positive guidance. A double-acting hydraulic ram 15 is provided within each of the telescopic guides 4, the rams 15 being connected to the frames 3 and 3′ by means of brackets 16.

Each plank 10 is provided with a pair of hydraulic bracing rams 19 and 19′, the cylinders of which are connected respectively to the frames 3 and 3′, and the piston rods, 20 and 20′ of which are provided with guide plates 21 and 21′ which are a sliding fit within the guide 11 of that plank. Each plank 10 is also provided with a hydraulic advance ram 23 which is connected thereto by means of a bracket 22, the rear frame 3′ forming an abutment for the rams 23, a respective bracket 24 connecting each of the rams 23 to the rear frame.

Assuming it is in the position shown in FIG. 1 with the planks 10 and the front frame in the rearmost positions, the knife shield is operated in the following manner. The hydraulic bracing rams 19′ associated with the rear frame 30′ are extended to brace the planks 10 radially outwards against the surrounding tunnel wall (not shown). The load exerted upon the shield is, therefore, taken up by the frame 3′. The planks 10 are then advanced, either singly or in groups, by means of their rams 23. As this happens, material (not shown) is cut away from the work-face and is removed rearwardly by means of a conveyor 25. During these operations, the bracing rams 19 associated with the front frame 3 are retracted so that the front frame is unloaded. When all the planks 10 have been advanced, the front frame 3 is advanced by means of the hydraulic rams 15. During the advance of the front frame 3, it is guided accurately with respect to the braced, stationary rear frame 3′ by means of the telescopic guides 4. Once the front frame 3 has been advanced by the full working stroke of the rams 15, the bracing rams 19 are extended to brace the planks 10 against the surrounding tunnel wall. The rams 19′ are then retracted so that the front frame 3 takes up the load exerted upon the shield by the surrounding material, and the rear frame 3′ is unloaded. The rams 15 are then retracted to draw up the rear frame 3′ by a distance corresponding to the length of the working stroke of these rams. At the same time, the hydraulic rams 23 are retracted, so that the planks 10 return to their rearmost positions. During the advance of the rear frame 3′, it is accurately guided with respect to the firmly anchored front frame 3 by means of the telescopic guides 4. The rams 19′ are then extended and the rams 19 are extended so that the knife shield is again in the position shown in FIG. 1 and is ready to repeat the cycle of operations just described.

During the advance of the rear frame 3′, it is possible, by suitable control of certain of the hydraulic rams 23, to advance the corresponding planks 10, providing the rams 19 associated with these planks have previously been retracted. This step speeds up the advance of the planks 10 in the subsequent cycle.

It also lies within the scope of the present invention to provide a tunnel drive shield which is not a knife shield. Here, each of the frames would be provided with a generally cylindrical shield shell, and the shell associated with the rear frame would be a telescopic sliding fit within the shell associated with the front frame.

It would also be possible, to secure one or both frames 3 and 3′ rigidly to individual planks 10 (or to groups of plans) so that these planks are advanced with the frame in question.

Where a change in the direction of tunnel advance is required (for example to incline the tunnel upwardly or downwardly, or to drive a curved tunnel), the entire shield 1 is repositioned, prior to the advance of the planks 10, by appropriate bracing of the rams 19 and 19′. The effect of this is to re-orient the axis 2 of the shield 1 and hence re-orient the direction 9 of tunnel advance.

We claim:

1. A drive shield for use in tunneling, the drive shield comprising:
   (a) a generally cylindrical shell supported by two frames spaced apart along the axis of the shell,
   (b) the two frames being movably mounted to be displaceable with respect to one another in the direction of said axis, and
   (c) guide means interconnect the two frames to permit relative movement therebetween only in the direction of said axis,
   (d) said guide means being effective to prevent the two frames from rotating with respect to each other.

2. A drive shield for use in tunneling, the drive shield comprising:
   (a) a generally cylindrical shell supported by two axially-spaced frames,
   (b) means movably mounting the frames to be displaceable with respect to each other in the direction of tunnel advance,
   (c) guide means interconnect the two frames to permit relative movement between the two frames only in the required direction of tunnel advance,
   (d) said guide means being effective to prevent the two frames from rotating with respect to each other.

3. A drive shield according to claim 2, wherein the guide means includes a plurality of guide devices laterally spaced with respect to each other.

4. A drive shield according to claim 3, wherein the guide devices are equispaced along the two frames.

5. A drive shield according to claim 3, wherein each guide device is a telescopic guide device.

6. A drive shield according to claim 5, wherein each guide device includes a pair of telescoped tubes of polygonal cross-section, one tube of each pair being fixed to one of the frames, the other tube of each pair being fixed to the other frame.

7. A drive shield for use in tunneling, the drive shield comprising:
   (a) a generally cylindrical shell supported by two axially-spaced frames which are displaceable relative to one another in the direction of tunnel advance,
   (b) guide means interconnect the two frames to permit the relative movement between the two frames only in the required direction of tunnel advance,
   (c) said guide means being effective to prevent the two frames from rotating with respect to each other,
   (d) said guide means including a plurality of telescopic guide devices laterally spaced with respect to each other, (e) each telescopic guide device including a pair of telescope tubes of rectangular cross-section, (f) one tube of each pair being fixed to one of the frames and the other tube of each pair being fixed to the other frame.

8. A drive shield according to claim 5, wherein said movably mounting means includes a double-acting hydraulic ram disposed within each telescopic guide device, each of the rams acting between the two frames for moving each frame with respect to the other.

9. A drive shield according to claim 2, wherein a plurality of elongate members constitute the shell, the elongate members being mounted in a parallel side-by-side relationship with their longitudinal axes extending parallel to the direction of tunnel advance.

10. A drive shield according to claim 9, wherein at least some of the elongate members are movable, relative to the frames, in the direction of tunnel advance.

11. A drive shield according to claim 2, wherein each frame includes means for anchoring that frame to provide an abutment for the advance of the other frame.

12. A drive shield according to claim 10, wherein each elongate member includes a pair of radially-aligned hydraulic bracing rams, one bracing ram of each pair being supported by one of the frames, and the other bracing ram of each pair being supported by the other frame, the bracing rams associated with each frame constituting means for anchoring that frame to provide an abutment for the advance of the other frame.

13. A knife shield for use in driving tunnels, the knife shield comprising:

(a) a plurality of elongate members supported by two axially-spaced frames, (b) the elongate members being mounted in a parallel, side-by-side relationship to define a generally cylindrical shell, (c) the two frames being movably mounted to be displaceable with respect to one another in the direction of tunnel advance, and (d) guide means interconnect the two frames to permit relative movement between the two frames only in the required direction of tunnel advance, (e) said guide means being effective to prevent the two frames from rotating with respect to each other.

14. A method of advancing a tunnel drive shield constituted by a generally cylindrical shell supported by two axially spaced frames, the method comprising the steps of:

(a) advancing a first of the frames while maintaining the second frame stationary, and then (b) advancing said second frame while maintaining said first frame stationary, (c) providing guide means interconnecting the two frames, (d) positively guiding and constraining each frame to move only in the direction of tunnel advance during its advance movement relative to the other frame by said guide means, (e) each frame being further prevented from rotating with respect to the other frame by said guide means.

15. A drive shield for use in tunneling, the drive shield comprising:

(a) a generally cylindrical shell supported by two frames spaced apart along the axis of the shell, (b) means for displacing the two frames with respect to one another in the direction of said axis, (c) guide means interconnect the two frames to permit relative movement therebetween only in the direction of said axis, (d) said guide means being effective to prevent the two frames from rotating with respect to each other.

16. A drive shield according to claim 15, wherein the guide means includes a plurality of guide devices laterally spaced with respect to each other.

17. A drive shield according to claim 16, wherein the guide devices are equispaced along the two frames.

18. A drive shield according to claim 16, wherein each guide device is a telescopic guide device.

19. A drive shield according to claim 18, wherein each guide device includes a pair of telescoped tubes of polygonal cross-section, one tube of each pair being fixed to one of the frames, and the other tube of each pair being fixed to the other frame.

20. A drive shield according to claim 15, wherein said displacing means includes a plurality of double-acting hydraulic rams fixed at each end thereof to a respective frame.

21. A drive shield according to claim 15, wherein a plurality of elongate members constitute the shell, the elongate members being mounted in a parallel side-by-side relationship with their longitudinal axes extending parallel to the direction of tunnel advance.

* * * * *